US007353864B2

(12) United States Patent
Zaffetti et al.

(10) Patent No.: US 7,353,864 B2
(45) Date of Patent: Apr. 8, 2008

(54) APPARATUS FOR REDUCING THERMAL FATIGUE IN HEAT EXCHANGER CORES

(75) Inventors: Mark Zaffetti, Suffield, CT (US); Kurt Stephens, Enfield, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 40 days.

(21) Appl. No.: 11/318,285

(22) Filed: Dec. 23, 2005

(65) Prior Publication Data

US 2007/0144717 A1 Jun. 28, 2007

(51) Int. Cl.
*F28F 3/06* (2006.01)

(52) U.S. Cl. ..... 165/166; 165/134.1; 165/906

(58) Field of Classification Search ..... 165/166, 165/167, 170, 134.1, 906
See application file for complete search history.

(56) References Cited

U.S. PATENT DOCUMENTS 3,216,732 A * 11/1965 Foust ..... 277/647
3,587,731 A * 6/1971 Hays ..... 165/140
3,992,168 A * 11/1976 Toyama et al. ..... 165/166
4,330,308 A * 5/1982 Grenier et al. ..... 165/166
4,971,137 A * 11/1990 Thompson ..... 165/276

* cited by examiner

*Primary Examiner*—Leonard R Leo
(74) *Attorney, Agent, or Firm*—Carlson, Gaskey & Olds

(57) ABSTRACT

A heat exchanger uses a skeleton forming of a lattice of first and second bars to provide a box-like structure. Blocking bars are arranged between gaps in the first and second bars to provide a blocking surface to divert airflow around a portion of the heat exchanger core. A brazing material is used in the assembly of the core and the skeleton, which includes the blocking bars.

12 Claims, 2 Drawing Sheets

APPARATUS FOR REDUCING THERMAL FATIGUE IN HEAT EXCHANGER CORES

BACKGROUND OF THE INVENTION

This invention relates to a heat exchanger that utilizes a high temperature aluminum subject to thermal fatigue due to heat cycles.

Aircraft air management systems utilize heat exchangers to provide cooling and/or heating for various components as well as cabin comfort. In an effort to reduce the weight of the systems, aluminum is used as the material of choice for some of the high operating temperature heat exchangers. Recent applications have exposed the aluminum heat exchangers to even higher temperatures. The result is a greater possibility for failures due to thermal fatigue.

To minimize structural failures and increase reliability, it has been shown that restricting cold side flow to certain areas of the cooling core within the heat exchanger reduces thermal stresses and thus thermal fatigue. A piece of sheet metal is typically used to serve as a blocking surface to divert flow around a portion of the heat exchanger that is typically subject to thermal fatigue. Welding the sheet metal to the core about its perimeter is not feasible because the welds cracked due to thermal stresses during the heat cycles.

To address this problem, the sheet metal has been secured to the core using a high temperature RTV to permit thermal expansion of the core. The sheet metal is also riveted to the heat exchanger since the RTV alone cannot reliably secure the sheet metal to the core over time.

The core must be cleaned so that the RTV can securely bond the sheet metal to the core. The additional time, preparation, and materials needed to secure the sheet metal to the core with this method adds cost to the heat exchanger. What is needed is an improved method and apparatus for providing the blocking surface on the heat exchanger.

SUMMARY OF THE INVENTION

The heat exchanger includes a core having first and second bars arranged transverse to one another to form a skeleton. The skeleton forms a box-like structure supporting hot and cold cooling fins. The bars are spaced from one another in a lattice to form gaps between the bars permitting airflow to pass through the skeleton and into the core. Blocking bars are arranged within the gaps, typically at the corners, between at least several of the bars to provide a blocking surface. The blocking surface diverts flow around a portion of the core that is typically subject to undesired thermal stresses due to a high temperature gradient in that area.

The core is typically constructed using a brazing material. The blocking bars are secured to the bars of the skeleton and/or other components within the heat exchanger using the same brazing material and preferably at the same time that the rest of the heat exchanger is assembled.

In this manner, bar material that is already used to provide the skeleton can also be used to provide the blocking surface. Furthermore, the same brazing material is used to construct the core and secure the blocking bars to the bars of the skeleton, and the blocking bars can be assembled at the same time. As a result, the cost and assembly time of the heat exchanger is reduced.

These and other features of the present invention can be best understood from the following specification and drawings, the following of which is a brief description.

DETAILED DESCRIPTION OF THE PREFERRED EMBODIMENT

Figure 1A:
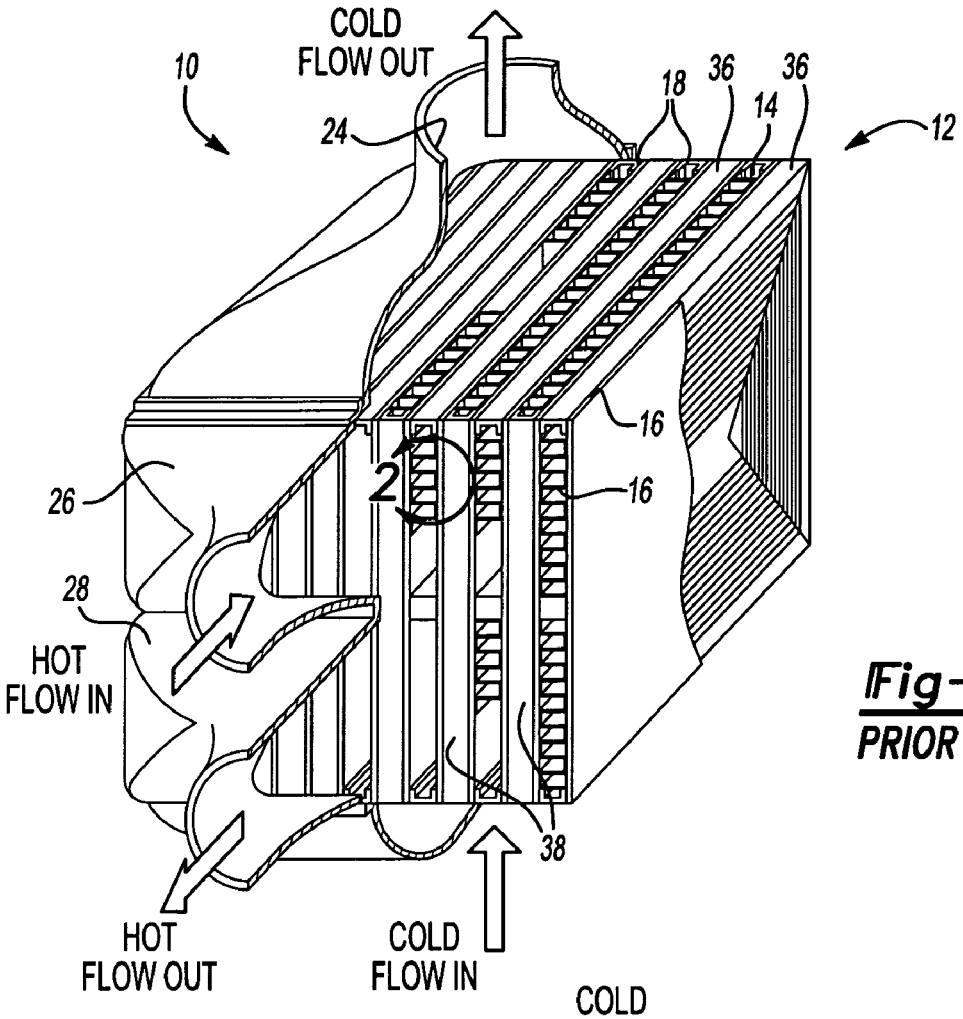
Fig-1A PRIOR ART
FIG. 1A is a perspective, partially broken view of a prior art heat exchanger.
Figure 1B:
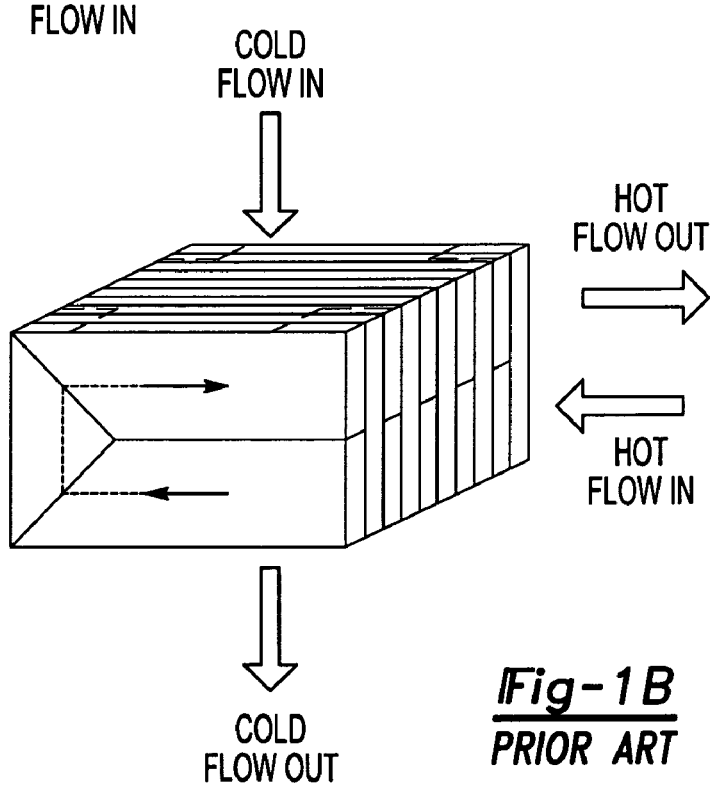
Fig-1B PRIOR ART
FIG. 1B is a perspective, schematic view of the airflow through the heat exchanger shown in FIG. 1A.

FIG. 1A depicts a prior art heat exchanger 10. Heat exchanger 10 includes a core 12 that includes a series of cold and hot fins 14 and 16 arranged transverse to one another. The cold fins 14 carry cold airflow in one direction, as indicated by the arrows in the Figures, and the hot fins 16 carry airflow in a direction generally transverse to the direction of the airflow within the cold fins. This airflow is the best schematically depicted in FIG. 1B and is well-known by those of ordinary skill.

Figure 2:
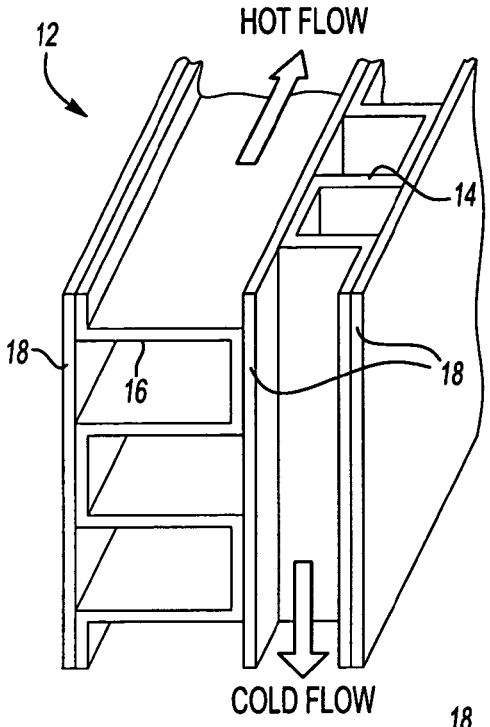
Fig-2 PRIOR ART
FIG. 2 is a perspective view of the hot and cold cooling fins shown in FIG. 1B.
Figure 3:
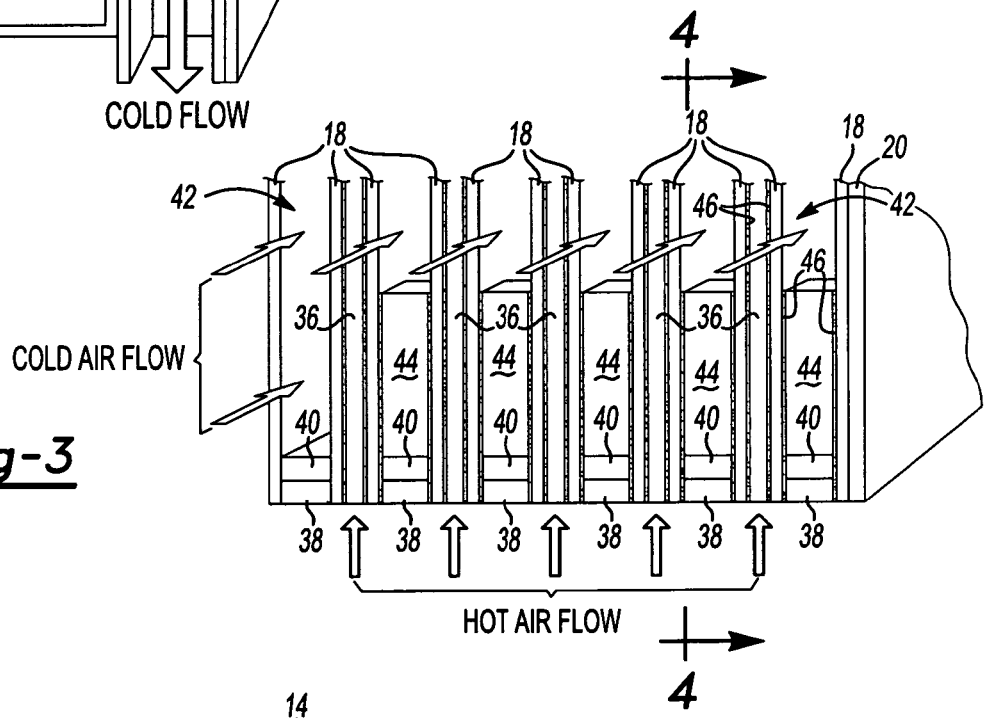
FIG. 3 is an enlarged, perspective view of a corner of the inventive heat exchanger.

The cold and hot fins 14 and 16 are separated from one another to provide enclosed air passages by securing parting sheets 18 to the cold and hot fins 14 and 16, which is best shown in FIGS. 1A and 2. End sheets 20 are placed on the ends of the core, as shown in FIG. 3. The end sheet 20 is not shown in FIG. 1A for clarity.

Typically the parting and end sheets 18 and 20 and the cold and hot fins 14 and 16 are secured together using a brazing material. One suitable example is a foil-type braze material that has a melt temperature of approximately between 1100-1175° F. The flow is directed through the cold and hot fins 14 and 16 by headers. The cold-in header is not shown in FIG. 1A. The cold out header 24 carries flow out of the heat exchanger 10. In a similar manner, the hot-in header 26 carries hot air into the heat exchanger 10, and the hot-out header 28 carries heat out of the heat exchanger 10. FIG. 1A depicts a single heat exchanger arrangement.

Figure 4:
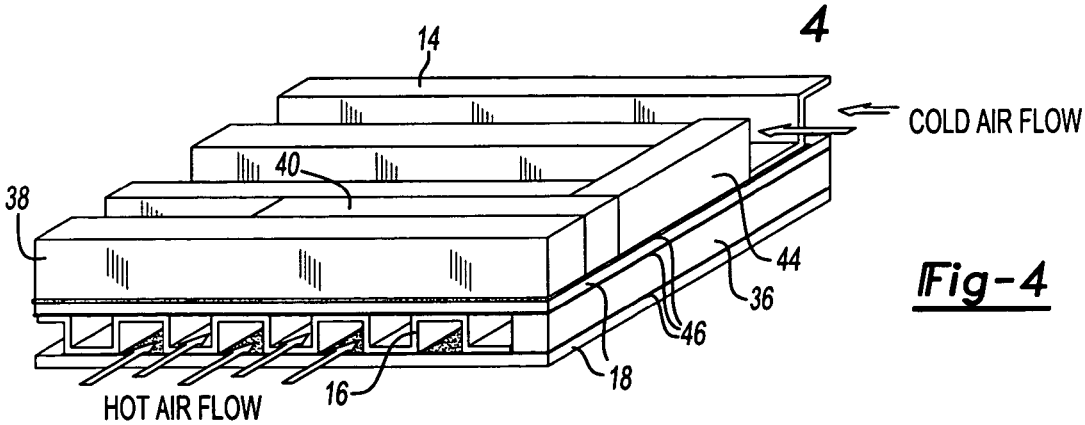
FIG. 4 is a view taken along line 4-4 in FIG. 3.

FIGS. 3 and 4 illustrate a skeleton that is used to structurally support the core 12. The skeleton is provided by first and second bars 36 and 38 arranged in alternating relationship to form a box-like, lattice structure. The first bars 36 provide the vertical walls and the second bars 38 provide the horizontal walls, as illustrated in FIG. 3. The first and second bars 36 and 38 are not shown for clarity. The first and second bars 36 and 38 are spaced apart from one another to provide gaps 42 to permit airflow through the skeleton and into the fin within. Reinforcing bars 40 are used in addition to first and second bars 36 and 38 to structurally reinforce various joints in the skeleton, as best illustrated in FIG. 4. The first and second bars 36 and 38 and reinforcing bars 40 are secured to one another using brazing material 46 that is part of the parting sheet 18, which is best shown in FIG. 3.

Blocking bars 44 are arranged between the gaps 42 in desired locations typically subject to thermal fatigue, such as the corners of the skeleton. One such corner is shown in FIG. 3, and the corners where the inventive blocking is desirable is shown by the dashed lines in F*igure* 1B. The blocking bars 44 along with the first bars 36 provide a blocking surface to divert airflow around the blocking surface. In this manner, the area of the core in the corners will be subject to a lower temperature gradient thus reducing the thermal fatigue of the heat exchanger in this area.

The blocking bars 44 can be constructed from the same material as the first and second bars 36 and 38. The blocking bars 44 can be secured using the same brazing material used to secure the first and second bars 36 and 38 to one another and assembled the same assembly time. The same brazing material is used to secure the cold and hot fins 14 and 16 and the parting sheets and end sheets 18 and 20 so that an additional retention material is not necessary for providing the blocking surface.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A heat exchanger comprising:

first and second bars respectively extending in first and second directions transverse to one another to form a skeleton, at least some of the first bars forming a side with gaps between the first bars;

a core including cooling fins arranged within the skeleton, wherein the cooling fins include a set of cold fins and a set of hot fins arranged transverse to one another;

parting sheets arranged between the cooling fins;

blocking bars extending in the first direction a length and arranged within the gaps between the at least some of the first bars, the blocking bars including first and second widths each less than the length, the at least some of the first bars and lengths of the blocking bars forming a blocking surface diverting flow around a portion of the core for reducing thermal stress in an area of the portion; and a header surrounding a portion of the side and in fluid communication with the gaps, wherein the blocking surface is arranged proximate to a corner of the core within the header.

2. The heat exchanger according to claim 1, wherein the blocking and first and second bars are constructed from an aluminum material.

3. The heat exchanger according to claim 2, wherein a brazing material is arranged between the blocking and first and second bars to secure the bars to one another.

4. The heat exchanger according to claim 1, wherein the blocking surface is arranged at a cold inlet of the cold fins corresponding to a first temperature and proximate to a hot inlet of the hot fins corresponding to a second temperature greater than the first temperature, the cold inlet provided by the header.

5. The heat exchanger according to claim 4, wherein at least two blocking surfaces are arranged at spaced apart corners on a same side of the skeleton.

6. The heat exchanger according to claim 5, wherein four blocking surfaces are arranged on the corners of the same side of the skeleton.

7. The heat exchanger according to claim 1, wherein the blocking surface includes an unbroken surface provided by a width and a length, the width and the length each exceeding the sum of a thickness of both a first and second bars.

8. A heat exchanger comprising:

a heat exchanger core including cooling fins and structural components secured to one another by a brazing material, parting sheets arranged between the cooling fins;

a blocking surface secured to at least one of the core and the structural components with the brazing material, the blocking surface diverting flow around a portion of the core for reducing thermal stress in an area of the portion;

wherein the structural components includes spaced apart bars providing a skeleton having gaps, the blocking surface provided by blocking bars arranged in at least some of the gaps, the spaced apart bars and the blocking bars extending longitudinally in the same direction as one another; and a header secured to the heat exchanger core, and the blocking surface x within the header.

9. The heat exchanger according to claim 8, wherein first and second blocking bars are arranged in adjacent gaps to provide the blocking surface, one of the spaced apart bars arranged between the first and second blocking bars, the blocking surface having an unbroken surface extending laterally across the first and second blocking bars and the one of the spaced apart bars.

10. The heat exchanger according to claim 9, wherein the blocking surface is proximate to a corner of the core.

11. The heat exchanger according to claim 8, wherein the cooling fins include cold and hot fins separated by the parting sheets, the structural components including the parting sheet with the braze material securing the cooling fins to the parting sheet.

12. A heat exchanger comprising:

first and second bars respectively extending in first and second directions transverse to one another to form a skeleton, at least some of the first bars forming a side with gaps between the first bars;

core including cooling fins arranged within the skeleton;

parting sheets arranged between the cooling fins;

blocking bars extending in the first direction length and arranged within the gaps between the at least some of the first bars, the blocking bars including first and second widths each less than the length, the at least some of the first bars and lengths of the blocking bars forming a blocking surface diverting flow around a portion of the core for reducing thermal stress in an area of the portion; and a reinforcing bar adjoining the second bar between a pair of first bars, an end of the reinforcing bar arranged between the blocking bar and the second bar.

* * * * *

UNITED STATES PATENT AND TRADEMARK OFFICE

CERTIFICATE OF CORRECTION

PATENT NO. : 7,353,864 B2
APPLICATION NO. : 11/318285
DATED : April 8, 2008
INVENTOR(S) : Zaffetti et al.

It is certified that error appears in the above-identified patent and that said Letters Patent is hereby corrected as shown below:

Claim 8, Column 4, line 21: delete “x”

Claim 12, Column 4, line 41: insert --a-- before “core”

Claim 12, Column 4, line 43: insert --a-- after “direction” and before “length”

Signed and Sealed this

Eighth Day of July, 2008

JON W. DUDAS
*Director of the United States Patent and Trademark Office*